US010755887B2

(12) United States Patent
Andrews

(10) Patent No.: US 10,755,887 B2
(45) Date of Patent: Aug. 25, 2020

(54) LARGE ANGLE ANODE TARGET FOR AN X-RAY TUBE AND ORTHOGONAL CATHODE STRUCTURE

(71) Applicant: Varex Imaging Corporation, Salt Lake City, UT (US)

(72) Inventor: Gregory C. Andrews, West Jordan, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 299 days.

(21) Appl. No.: 15/872,317

(22) Filed: Jan. 16, 2018

(65) Prior Publication Data

US 2018/0204703 A1 Jul. 19, 2018

Related U.S. Application Data

(60) Provisional application No. 62/446,802, filed on Jan. 16, 2017.

(51) Int. Cl.

| | |
|---|---|
| ***H01J 35/10*** | (2006.01) |
| ***H01J 9/18*** | (2006.01) |
| ***H01J 35/16*** | (2006.01) |
| *H01J 35/18* | (2006.01) |

(52) U.S. Cl.

CPC ..... *H01J 35/101* (2013.01); *H01J 9/18* (2013.01); *H01J 35/10* (2013.01); *H01J 35/108* (2013.01); *H01J 35/16* (2013.01); *H01J 35/18* (2013.01)

(58) Field of Classification Search

CPC .... H01J 35/10; H01J 35/101; H01J 2235/086; H01J 35/1046; H01J 35/103; H01J 35/26; H01J 35/305

See application file for complete search history.

(56) References Cited

U.S. PATENT DOCUMENTS

| | | | | |
|---|---|---|---|---|
| 3,836,804 | A | 9/1974 | Frens et al. | |
| 4,901,338 | A | 2/1990 | Rodhammer et al. | |
| 6,430,264 | B1 * | 8/2002 | Lee | H01J 35/108 378/143 |
| 2010/0322384 | A1 * | 12/2010 | Parker | H01J 35/10 378/127 |

FOREIGN PATENT DOCUMENTS

| | | | |
|---|---|---|---|
| BE | 1001995 | A7 | 5/1990 |
| DE | 345277 | C | 12/1921 |

OTHER PUBLICATIONS

International Preliminary Report on Patentability dated Jul. 16, 2019 in relation to PCT/US2018/013907.

* cited by examiner

*Primary Examiner* — Don K Wong
(74) *Attorney, Agent, or Firm* — Maschoff Brennan

(57) ABSTRACT

Technology is described for steep angle of a focal track of an anode of an x-ray tube. In one example, an anode includes a disc-shaped anode and a focal track. The disc-shaped anode includes a bearing-facing surface, a window-facing surface positioned opposite the bearing-facing surface, and a focal track positioned between the window-facing surface and the bearing-facing surface, wherein the focal track is angled with respect to the window-facing surface, and the angle between the focal track and the window-facing surface is between 45° and 89°.

20 Claims, 6 Drawing Sheets

LARGE ANGLE ANODE TARGET FOR AN X-RAY TUBE AND ORTHOGONAL CATHODE STRUCTURE

CROSS-REFERENCE TO RELATED APPLICATIONS

This application claims priority to and the benefit of U.S. Provisional Application No. 62/446,802, filed Jan. 16, 2017, entitled LARGE ANGLE ANODE TARGET FOR AN X-RAY TUBE AND ORTHOGONAL CATHODE STRUCTURE, which is hereby incorporated by reference in its entirety.

BACKGROUND

Unless otherwise indicated herein, the approaches described in this section are not prior art to the claims in this disclosure and are not admitted to be prior art by inclusion in this section.

An x-ray system typically includes an x-ray tube and a detector. The power and signals for the x-ray tube can be provided by a high voltage generator. The x-ray tube emits radiation, such as x-rays, toward an object. The object is positioned between the x-ray tube and the detector. The radiation typically passes through the object and impinges on the detector. As radiation passes through the object, structures of the object attenuate the radiation received at the detector. The detector then generates data based on the detected radiation, and the system translates the radiation variances into an image, which may be used to evaluate the structure of the object, such as a patient in a medical imaging procedure or an inanimate object in an inspection scan.

The x-ray tube includes a cathode and an anode. X-rays are produced in x-ray tubes by applying an electrical current to an emitter positioned within the cathode to cause electrons to be emitted from the cathode by thermionic emission. In a vacuum, the electrons accelerate towards and then impinge upon the anode due to the voltage difference between the cathode and the anode. When the electrons collide with a target on the anode, some of the energy is emitted as x-rays, and the majority of the energy is released as heat. The area on the anode in which the electrons collide is generally known as the focal spot. Because of high temperatures generated when the electron beam strikes the target, specifically the focal spot, the anode can include features to distribute the heat generated at the focal spot on the target, such as rotating a disc-shaped anode target at a high rotational speed. A rotating anode typically includes the disc-shaped anode target, which is rotated by an induction motor via a bearing assembly. The x-ray tube can also be enclosed by x-ray shielding material, such as lead, to keep other non-useful x-rays, such as back scatter x-rays, from being emitted from the system.

The radiation detector (e.g., x-ray detector) can include a conversion element that converts an incoming radiation beam into electrical signals, which can be used to generate data about the radiation beam, which in turn can be used to characterize an object being inspected (e.g., the patient or inanimate object). In one example, the conversion element includes a scintillator that converts a radiation beam into light, and a sensor that generates electrical signals in response to the light. The detector can also include processing circuitry that processes the electrical signals to generate data about the radiation beam.

The x-ray tube and radiation detector can be components in an x-ray system, such as a computed tomography (CT) system or scanner, which includes a gantry that rotates both the x-ray tube and the detector to generate various images of the object at different angles. Often, x-ray tubes are relatively heavy due to the materials used, such as lead (Pb) for x-ray shielding. Reducing the weight of x-ray tubes can reduce the strain on the gantry for CT applications and allow a user to manipulate the x-ray tube during an examination with greater ease.

The technology (systems, devices, and methods) described herein provides solutions to reduce the weight and improve the form factor of x-ray tubes.

DETAILED DESCRIPTION OF SOME EXAMPLE EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives (e.g., a disjunction operator, or an exclusive or) or a combination of the alternatives (e.g., a conjunction operator, and/or, a logical or, or a Boolean OR).

The invention relates generally to a steep target angle of a focal track of an anode of an x-ray tube relative to the circular plane surface of the anode, and more particularly, a radially outward orientation of the cathode to the anode. Example embodiments and descriptions illustrate various target angle on a tapered portion of the anode (or target).

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

Example X-Ray Tubes

Figure 1:
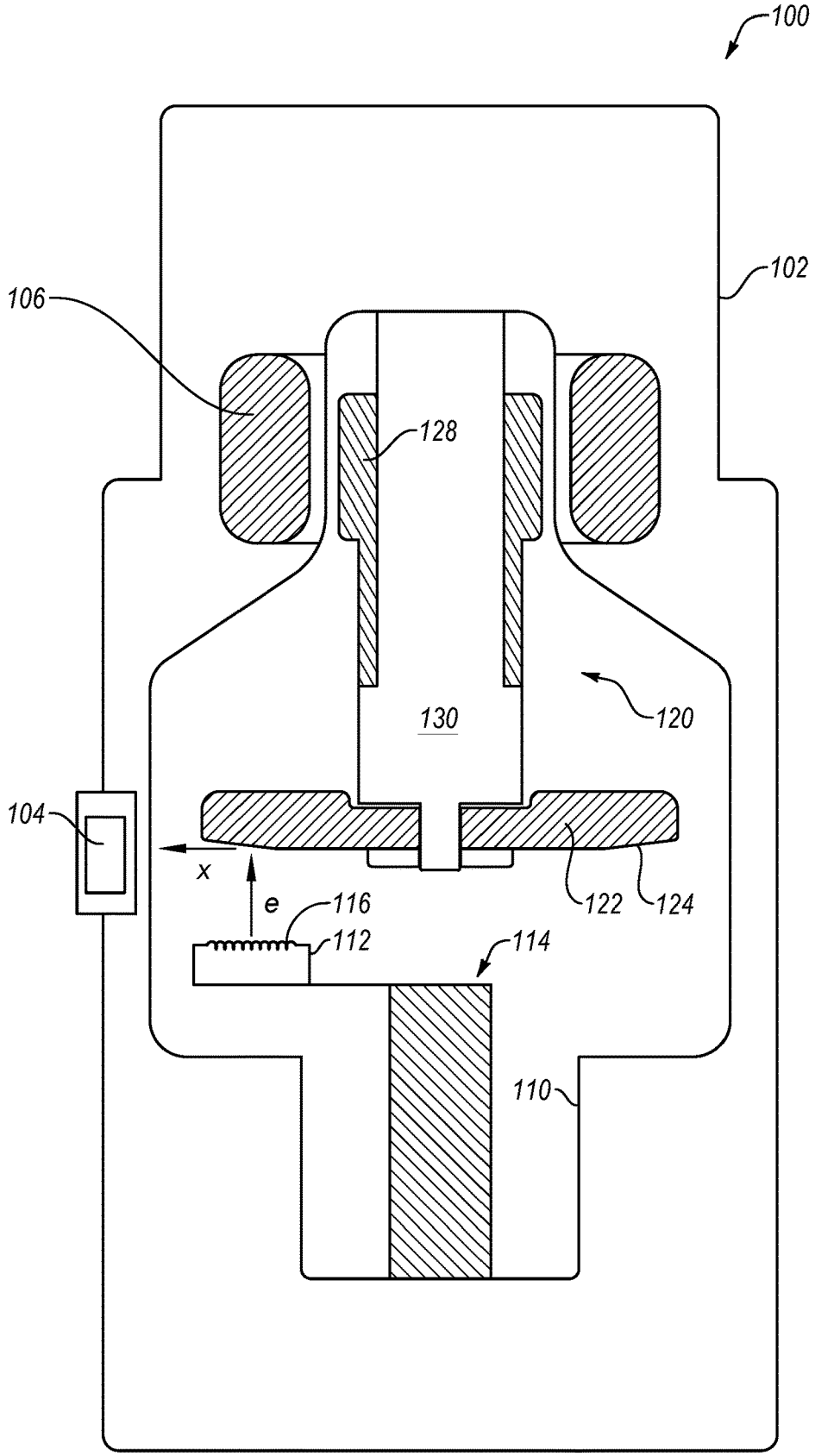
FIG. 1 illustrates a block diagram of an example x-ray tube.

FIG. 1 is a block diagram of an example rotary or rotating anode type x-ray tube 100 with a rotatable disc-shaped anode 122. The x-ray tube 100 includes a housing 102 and an x-ray insert 110 within the housing 102. The housing 102 encloses the insert 110. A coolant or air may fill the space or cavity between the housing 102 and the insert 110. A cathode assembly 114 and an anode assembly 120 are positioned within an evacuated enclosure, also referred to as the insert 110. The cathode assembly 114 includes a cathode 112. The anode assembly 120 includes the anode 122, a bearing assembly 130, and a rotor 128 mechanically coupled to the bearing assembly 130. The anode 122 is spaced apart from and oppositely disposed to the cathode 112. The anode 122 and the cathode 112 are connected in an electrical circuit that allows for the application of a high voltage potential between the anode 122 and the cathode 112. The cathode 112 includes an electron emitter 116 that is connected to an appropriate power source (not shown).

As disclosed in FIG. 1, prior to operation of the example x-ray tube 100, the insert 110 is evacuated to create a vacuum. The insert 110 encloses the vacuum. Then, during operation of the example x-ray tube 100, an electrical current is passed through the electron emitter 116 of the cathode 112 to cause electrons "e" to be emitted from the cathode 112 by thermionic emission. The application of a high voltage differential between the anode 122 and the cathode 112 then causes the electrons "e" to accelerate from the electron emitter 116 toward a focal spot on a focal track 124 that is positioned on the anode 122. The focal track 124 may include materials having a high atomic ("high Z") number such as tungsten (W), and rhenium (Re), molybdenum (Mo), rhodium (Rh), Iridium (Ir), or other suitable materials. As the electrons "e" accelerate, they gain a substantial amount of kinetic energy, and upon striking the rotating focal track 124, some of this kinetic energy is converted into x-rays "x".

The focal track 124 is oriented so that emitted x-rays "x" are visible to an x-ray tube window 104. The x-ray tube window 104 includes an x-ray transmissive material, such as beryllium (Be), so the x-rays "x" emitted from the focal track 124 pass through the x-ray tube window 104 in order to strike an intended object (not shown) and then the detector to produce an x-ray image (not shown). FIG. 1 illustrates a single window 104 on the housing 102 (e.g., with a glass insert that allows radiation to pass through the glass of the insert). In other examples, a separate window may be included on both the insert 110 (e.g., a metal insert) and the housing 102, or a window may be included on just the insert 110.

As the electrons "e" strike the focal track 124, a significant amount of the kinetic energy of the electrons "e" is transferred to the focal track 124 as heat. To reduce the heat at a specific focal spot on the focal track 124, a disc-shaped anode target is rotated at high speeds, typically using an induction motor that includes a rotor 128 and a stator 106. The induction motor can be an alternating current (AC) electric motor in which the electric current in the rotor 128 needed to produce torque is obtained by electromagnetic induction from a magnetic field of stator winding. Then, the rotor 128 rotates a hub of the bearing assembly 130 that is mechanically coupled to the anode 122, which rotates the anode 122. In another example (not shown), the motor can be a direct current (DC) motor.

X-rays "x" are produced when high-speed electrons "e" from the cathode 112 are suddenly decelerated by striking the focal track 124 on the anode 122. To avoid overheating the anode 122 from the electrons "e", the rotor 128 and sleeves (not shown) rotate the anode 122 and other rotatable components at a high rate of speed (e.g., 80-300 Hz) about a centerline of a center shaft (not shown). The x-ray tube 100 can also include other cooling features to reduce the heat generated by the anode 122 and the cathode 112.

After the x-rays are emitted from the x-ray tube, the x-rays strike an intended object (e.g., the patient or inanimate object) and then the radiation detector to produce an x-ray image. The radiation detector includes a matrix or array of pixel detector elements. The pixel detector elements (e.g., x-ray detector element or detector element) refers to an element in a matrix or array that converts x-ray photons to electrical charges. A detector element may include a photoconductor material which can convert x-ray photons directly to electrical charges (electron-hole pairs) in a direct detection scheme. Suitable photoconductor material include and are not limited to mercuric iodide ($HgI_2$), lead iodide ($PbI_2$), bismuth iodide ($BiI_3$), cadmium zinc telluride (CdZnTe), or amorphous selenium (a-Se). In some embodiments, a detector element may comprise a scintillator material which converts x-ray photons to light and a photosensitive element coupled to the scintillator material to convert the light to electrical charges (i.e., indirect detection scheme). Suitable scintillator materials include and are not limited to gadolinium oxisulfide ($Gd_2O_2S$:Tb), cadmium tungstate ($CdWO_4$), bismuth germanate ($Bi_4Ge_3O_{12}$ or BGO), cesium iodide (CsI), or cesium iodide thallium (CsI:Tl)). Suitable photosensitive element may include a photodiode, a photogate, or phototransistors. Other circuitry for pixel detector elements may also be used.

Figure 2:
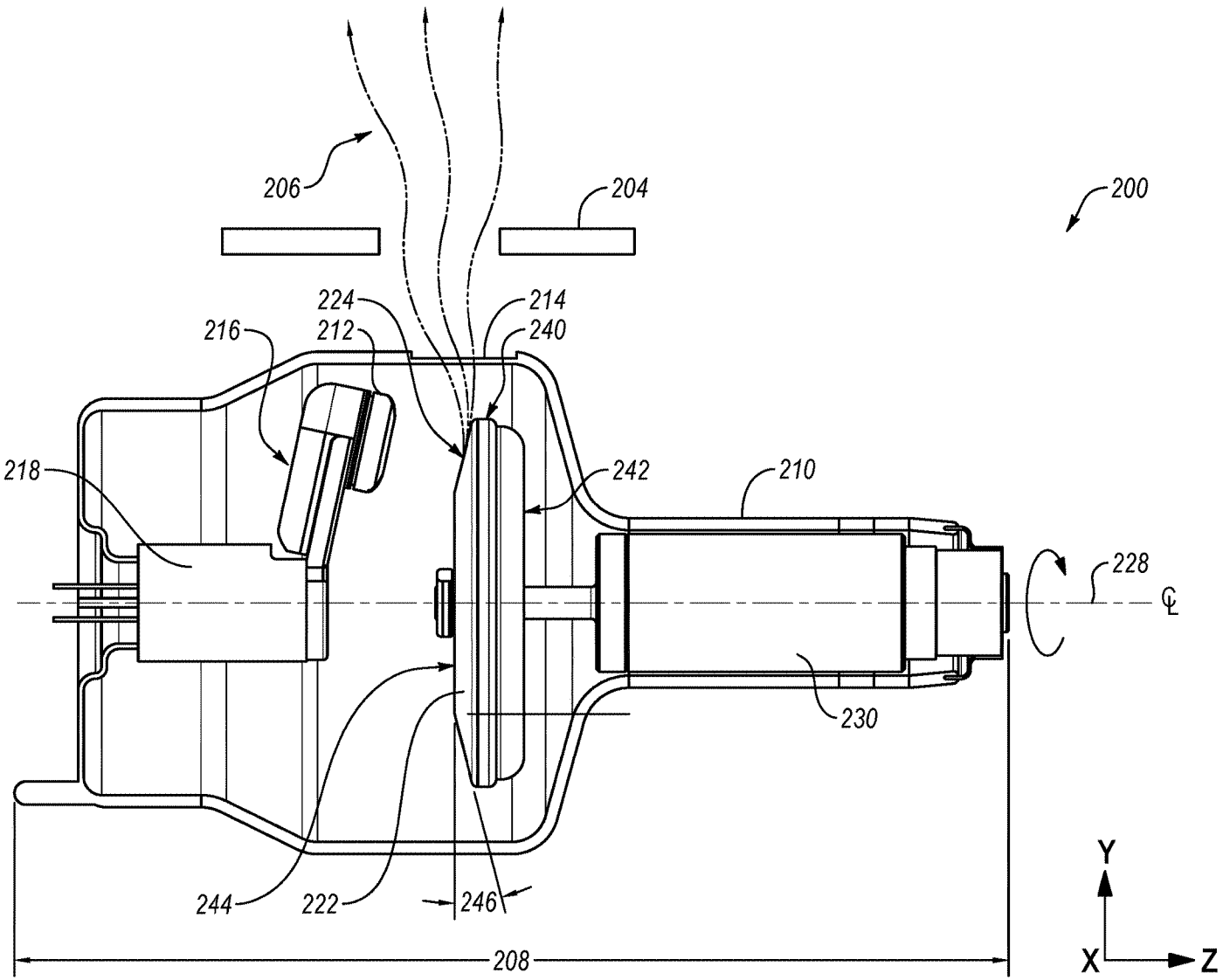
FIG. 2 illustrates a partial cross section view of an x-ray tube with a cathode oriented axially from the anode.

FIG. 2 is a diagram of an example rotary or rotating anode type x-ray tube 200 with a rotatable disc-shaped anode 222. The x-ray tube 200 includes a vacuum envelope 210 enclosing the anode 222 and a cathode 212. The geometry of the anode 222 includes a surface 240 between a bearing-facing circular plane surface 242 proximal to and facing a bearing assembly 230 and a cathode-facing circular plane surface 244 proximal to and facing the cathode 212. The anode 222 includes a centerline for the axis of anode rotation (i.e., anode rotation axis 228), and extends along an axial length 208. The anode 222 may include a disc-shaped anode body. In some configurations, the anode body may include a substrate and a coating that forms the focal track 224. The substrate may include materials with suitable thermal characteristics such as molybdenum (Mo) alloy, graphite, or other suitable materials. The focal track 224 may be coated on the substrate with a target material, such as W and Re. In other configurations, the focal track 224 may not be a coating, and may be integral to the anode body. For example, the anode 222 may be formed of W or Mo, and the focal track 224 may be formed on the surface of the anode 222, because the anode 222 is formed of a suitable material for the focal track 224. The focal track 224 is tapered or angled from the cathode-facing circular plane surface 244 to direct generated x-rays 206 (e.g., center ray beam) from high-energy electrons towards a specific direction, such as an x-ray window 214.

A target angle 246 can refer to the angle between a circular plane surface (e.g., the cathode-facing circular plane surface 244) and the tapered focal track 224. Conventionally, for the cathode 212 directed toward the cathode-facing circular plane surface 244, the cathode structure 216 and its support structure 218 are displaced axially with respect to the anode 222. The electrons emitted from the cathode 212 travel mostly parallel to the anode rotation axis 228 before interacting with the anode 222. X-rays produced by such conventional tubes may be collimated by a collimator 204 (or the x-ray window 214) to exit transverse to or perpendicular to the anode rotation axis 228. As a result, the patient or object to be imaged is usually located in a direction perpendicular to the anode rotation axis 228. To produce x-rays that are transverse, perpendicular or orthogonal to the anode rotation axis 228, the target angle 246 ranges from 0° to 25°, and more typically between 7° and 16°.

Figure 3:
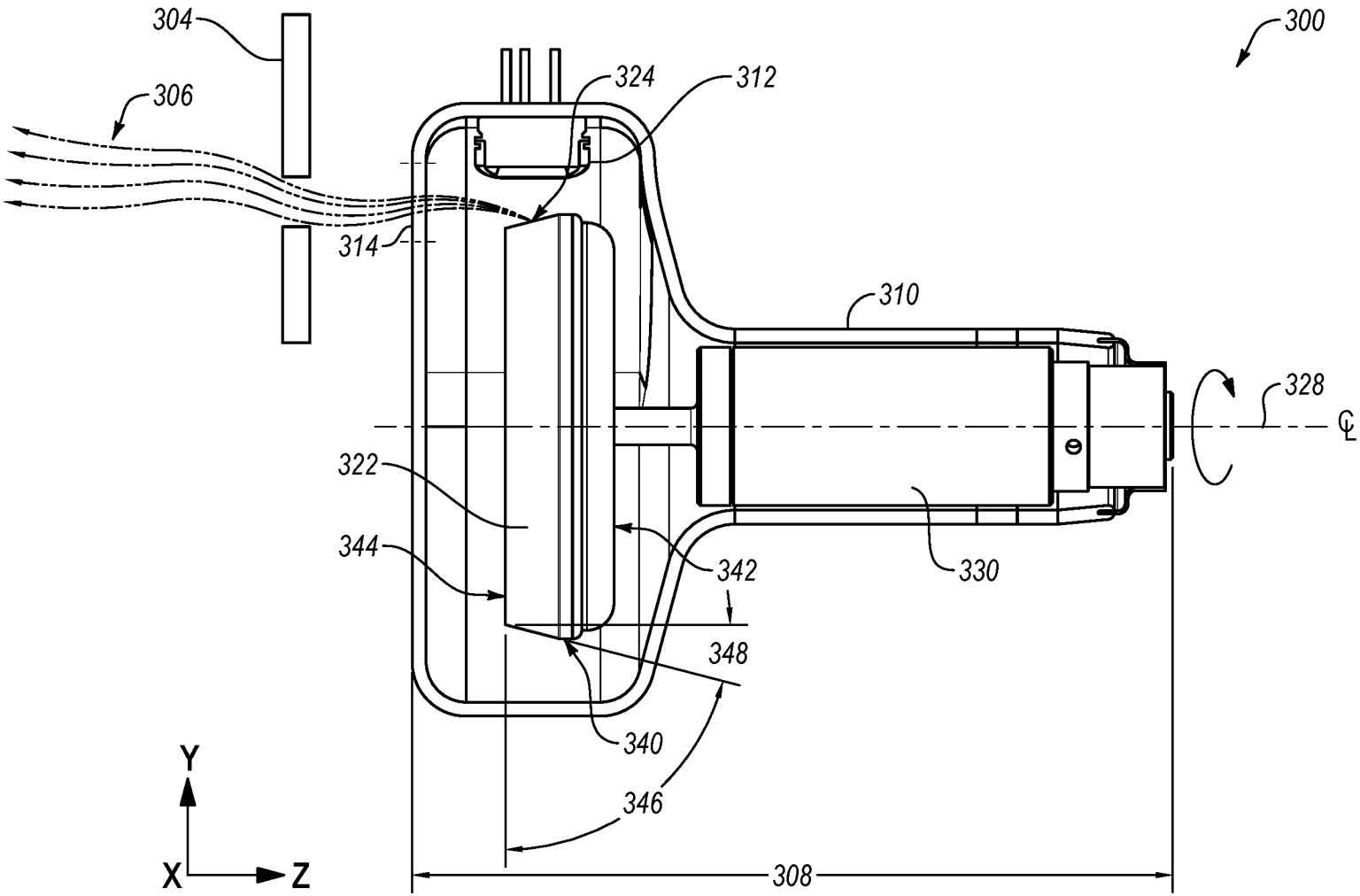
FIG. 3 illustrates a partial cross section view of an x-ray tube with a cathode oriented radially from the anode.

FIG. 3 is a diagram of an example rotary or rotating anode type x-ray tube 300 with a rotatable disc-shaped anode 322. The x-ray tube 300 includes a vacuum envelope 310 enclosing the anode 322 and a cathode 312. The disc-shaped anode 322 can have the shape of a cone frustum or truncated cone. The geometry of the anode 322 includes a surface 340 between a bearing-facing circular plane surface 342 proximal to and facing a bearing assembly 330 and a window-facing circular plane surface 344 distal to the bearing assembly 330 (or facing a window 314 or a collimator 304). The window-facing surface 344 is positioned opposite the bearing-facing surface 342. As illustrated, in some configurations, the surface 340 may include a curved portion and a substantially straight portion, although other suitable configurations may be implemented. The anode 322 includes a centerline for the axis of anode rotation (i.e., anode rotation axis 328), and extends along an axial length 308. In some configurations, the bearing assembly 330 may include a ball bearing assembly with at least one race, a roller element bearing, a plain bearing, a sleeve bearing, a journal bearing, or liquid metal bearing.

The anode 322 may include a disc-shaped anode body and a focal track 324 positioned between the window-facing surface 344 and the bearing-facing surface 342. As illustrated the focal track 324 is angled with respect to the window-facing surface 344. In some configurations, the anode 322 may include a substrate and a coating that forms a focal track 224. The substrate may include materials such as molybdenum (Mo) alloy, graphite, carbon fiber composite (CFC), titanium-zirconium-molybdenum (TZM), molybdenum-hafnium-carbon (MHC), other molybdenum alloy, or other suitable materials. CFC is an extremely strong and light fiber-reinforced plastic which contains carbon fibers, which may also be designed to withstand high temperatures. TZM (Mo [~99%], Ti [~0.5%], Zr [~0.08%] and some C) is a corrosion-resisting molybdenum superalloy and has about twice the strength of pure Mo. MHC is a particle-reinforced molybdenum-based alloy which contains both hafnium (Hf) and carbon (C).

The focal track may include materials having a high atomic ("high Z") number such as W, Re, Mo, Rh, Ir, or other suitable materials. In some configurations, the focal track 324 may be coated on the substrate with a target material, such as W Re, Mo, Rh, Ir, or other suitable materials. In other configurations, the focal track 324 may not be a coating, and may be integral to the anode body. For example, the anode 322 may be formed of W or Mo, and the focal track 324 may be formed on the surface of the anode 322, because the anode 322 is formed of a suitable material for the focal track 324. The focal track 324 may be a frustoconical surface extending around the circumference of the anode 322. Additionally or alternatively, the focal track 324 may extend around an edge surface proximate an outer circumference of the anode 322.

The focal track 324 may be tapered or angled from the window-facing circular plane surface 344 to direct generated x-rays (e.g., center ray beam) from high-energy electrons towards a specific direction, such as the x-ray window 314. A target angle 346 can refer to the angle between a circular plane surface (e.g., the window-facing circular plane surface 344 or the bearing-facing circular plane surface 342) and the tapered focal track 324.

The angle between the focal track 324 and the window-facing surface 344 may be referred to as the target angle 346. Additionally or alternatively, the angle between the focal track 324 and the bearing-facing surface 342 may be referred to as the target angle 346. In one example, the target angle 346 is at an angle between 45° and 89°, which allows x-rays to be generated axially (i.e., parallel with the axis of anode rotation 328) and the cathode 312 to be positioned radially outward from the anode 322. In another example, the target angle 346 is at an angle between 65° and 85°. In still another example, the target angle 346 is at an angle between 74° and 83°.

The target angle 346 can also be expressed relative to the surface 340 and/or the anode rotation axis 328. The angle between the focal track 324 and the surface 340 may be referred to as the radially inward angle 348. Additionally or alternatively, the angle between the focal track 324 and the anode rotation axis 328 may be referred to as the radially inward angle 348. Furthermore, the radially inward angle 348 may be the target angle 346 subtracted from a right angle [90° ] (see, for example, FIGS. 3 and 4A). For example, a 45° and 89° target angle 346 is a 1° and 45° radially inward angle 348. A 65° and 85° target angle 346 is a 5° and 25° radially inward angle 348. A 74° and 83° target angle 346 is a 7° and 16° radially inward angle 348. In the configuration shown in FIG. 3, the patient or object to be imaged can displaced axially with respect to the anode rotation axis 328. X-rays produced by the tube 300 shown may be collimated by a collimator 306 (or an x-ray window 314) such that they exit parallel to the anode rotation axis 328.

X-ray tube anodes are conventionally manufactured by a forging processes where the tungsten (and/or rhenium) focal track and substrate are bonded and formed together in the forging. Forging works well for shallow angles (e.g., less than a 45° angle, or more particularly less than a 25° angle), but traditional forging typically does not provide enough deformation in the radial direction for a high degree of densification of the focal track material.

Other alternate technologies, such as vacuum plasma spray and chemical vapor deposition (CVD), can be used to bond the focal track with the needed density to the substrate, especially for steeper target angles (e.g., greater than a 45° angle). Ion beam enhanced deposition (MED), physical vapor deposition (PVD), plasma-enhanced chemical vapor deposition (PECVD), or atomic layer deposition (ALD) may also be used. These technologies allow the target angle to be steeper (e.g., greater than a 45° angle), which can provide smaller size and lower weight x-ray tubes.

Fabricating steeper target angles on the anode allows the geometry of a rotating anode to change, and as a result, the rest of the x-ray tube as well, such that x-rays can be emitted from the end of the x-ray tube, parallel to the axis of anode rotation 328 (see, for example, FIG. 3) rather than the side of the x-ray tube, perpendicular to or radially from the axis of anode rotation 228 (see, for example, FIG. 2). The cathode 212 rather than being displaced lengthwise, as shown in FIG. 2, with respect to the anode, the cathode 312 can be displaced radially, as shown in FIG. 3. The geometry shown in FIG. 3 can reduce the x-ray source's axial length 308 and as a consequence the volume on the cathode "side" of the tube is reduced. The x-ray tube 300 in FIG. 3 can also have an increased instantaneous tube power rating for a given focal spot size and target diameter relative to a similar size x-ray tube shown in FIG. 2.

Figure 4A:
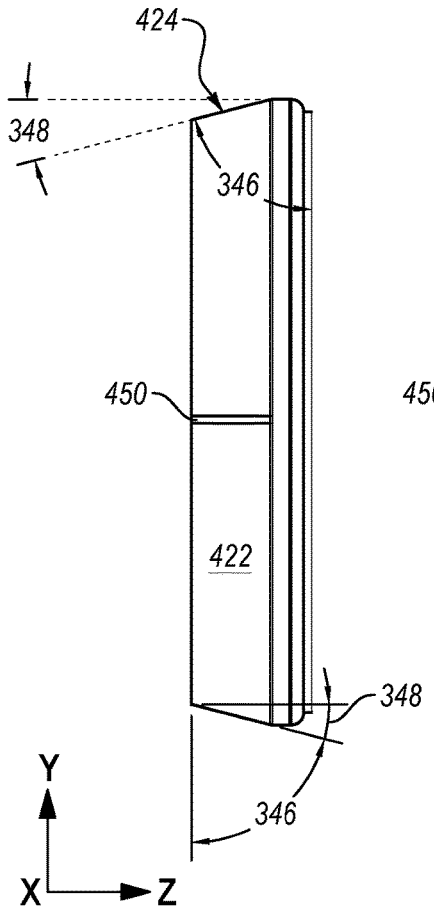
FIG. 4A illustrates a side view of a rotary anode.
Figure 4B:
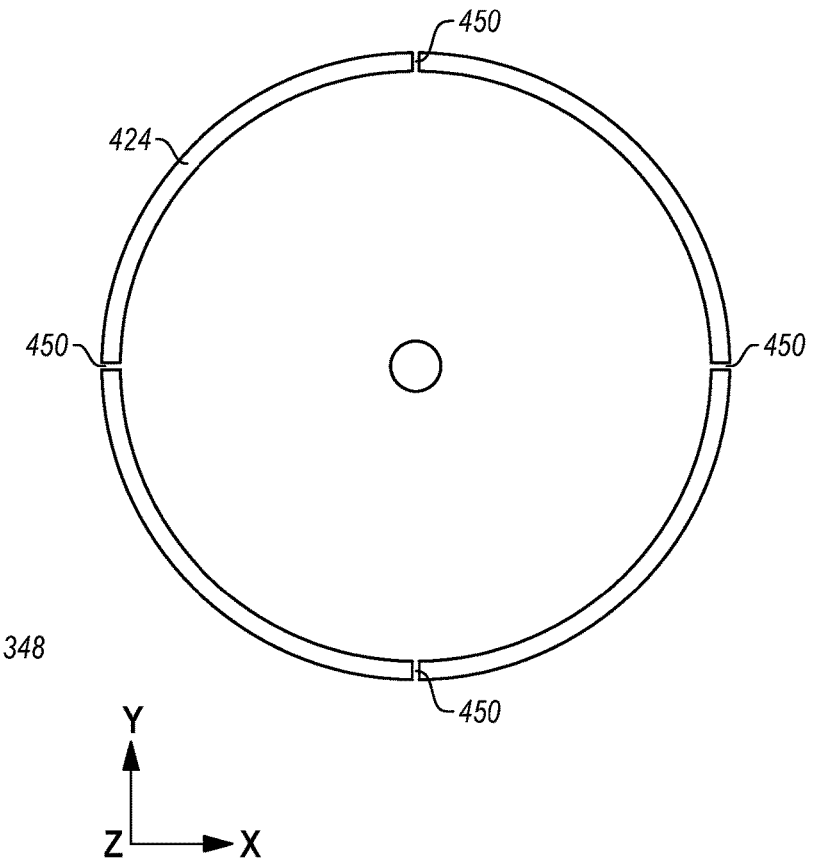
FIG. 4B illustrates another side view of the rotary anode shown in FIG. 4A.
Figure 4C:
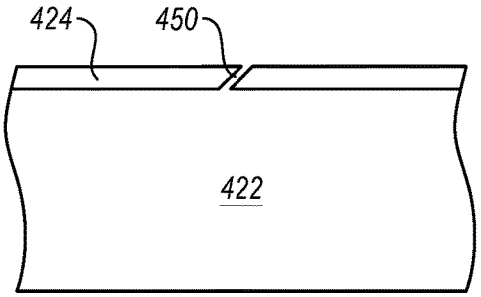
FIG. 4C illustrates a side cross section of a focal spot slot shown in FIGS. 4A-4B.

FIGS. 4A-4C illustrate various views of an anode 422. The anode 422 may include similar features as the anode 322 described above with respect to FIG. 3, and such features are indicated with the numbering set forth above. In addition, the anode 422 includes a focal track 424 with radial slots 450 defined therein. In some configurations, the focal track 424 may be a coating formed on a substrate. In other configurations, the focal track 424 may be formed by other suitable methods, and may be integral to the body of the anode 422.

In the illustrated configuration, the focal track 424 includes four radial slots 450. However, in other configurations any suitable number of slots 450 may be included. For example, some configurations may include at least two radial slots 450.

In configurations where the focal track 424 is a coating, the substrate material of the anode 422 may have a different coefficient of thermal expansion (CTE) from the focal track 424 coating, which can generate a shear force on the bond between the substrate and the focal track 424 for relatively large surface areas with changes in temperature. For example, CFC has a low CTE and comparatively W and Re used as focal track materials have a relatively high CTE. The radial slots 450 in the focal track can be used to reduce the surface area of the focal track 424, which can reduce the shear force on the bond between the substrate and the focal track 424. The slot can have an angled orientation so the edge of one edge of the focal track overlaps with another edge, as shown for example in FIG. 4C. Such configurations may allow the focal track to cover the entire path of the electron beam (leaving no portion of the substrate exposed to the majority of the electron beam emission).

The change to a steep or large target angle can help to reduce the x-ray tube size and lower x-ray tube weight without sacrificing power or functionality, which can reduce the overall size and tube support structure(s) for medical and industrial x-ray imaging systems, which is especially beneficial in portable systems. For a given maximum anode diameter, the mean focal track diameter (i.e., average diameter of the focal track) is increased with a corresponding increase in power relative to a conventional x-ray tube geometry and anode (e.g., radially generated x-rays similar to FIG. 2).

At least four benefits can occur with the tube configurations described herein. First, the cathode side (e.g., from the bearing-facing circular plane surface 242 or 342 to the rest of the rest of the cathode end of the x-ray [opposite the bearing assembly side of the x-ray tube]) of an x-ray tube housing usually requires x-ray shielding (e.g., lead [Pb]). Since lead is "heavy" reducing the cathode side volume reduces the lead used and has an appreciable impact on the overall tube weight. A lighter tube has many benefits for the system manufacturer, including reduced system cost through lighter mechanical design (e.g., lighter loads). Second, a shorter tube length is more desirable from a system design perspective. A shorter tube allows the x-ray system to have a greater range of motion, which in-turn allows for more flexibility in imaging. Third, on many mobile systems the x-ray tube length in particular obstructs the view of a technician or user moving the system from room to room. A shorter length obstructs an operators view less and allows the system to be transported more easily. Fourth, for a given anode or target diameter, the mean focal track diameter is greater than a traditional tube geometry, which allows higher power ratings. As a result, a tube with a steep target angle can be smaller, lighter and have a higher instantaneous rating than comparable tubes.

Figure 5:
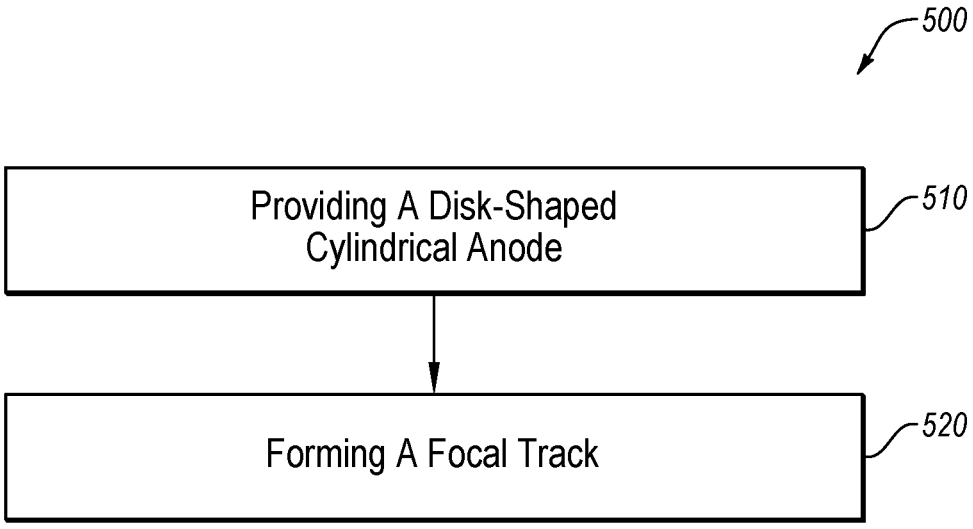
FIG. 5 is flowchart illustrating an example of a method of forming an anode for an x-ray tube.

The flowchart shown in FIG. 5 illustrates a method 500 of forming an anode for an x-ray tube. The method includes the step of providing a disk-shaped cylindrical anode, as in step 510. The next step of the method includes forming a focal track, as in step 520. In some configurations, forming a focal track may include depositing a coating material on a substrate surface at a taper to form the focal track. The focal track is configured to generate x-rays when electrons strike the focal track.

The coating material may be deposited by any suitable deposition technique. For example, depositing the coating material may include ion beam enhanced deposition (MED), physical vapor deposition (PVD), chemical vapor deposition (CVD), plasma-enhanced chemical vapor deposition (PECVD), and/or atomic layer deposition (ALD). The taper, the bearing-facing surface, or the window-facing surface of the anode may be formed by any suitable technique. For example, the taper, the bearing-facing surface, or the window-facing surface of the anode may be formed by grinding, polishing, lapping, abrasive blasting, honing, electrical discharge machining (EDM), milling, lithography, industrial etching/chemical milling, and/or laser texturing the disk-shaped cylindrical substrate.

Figure 6:
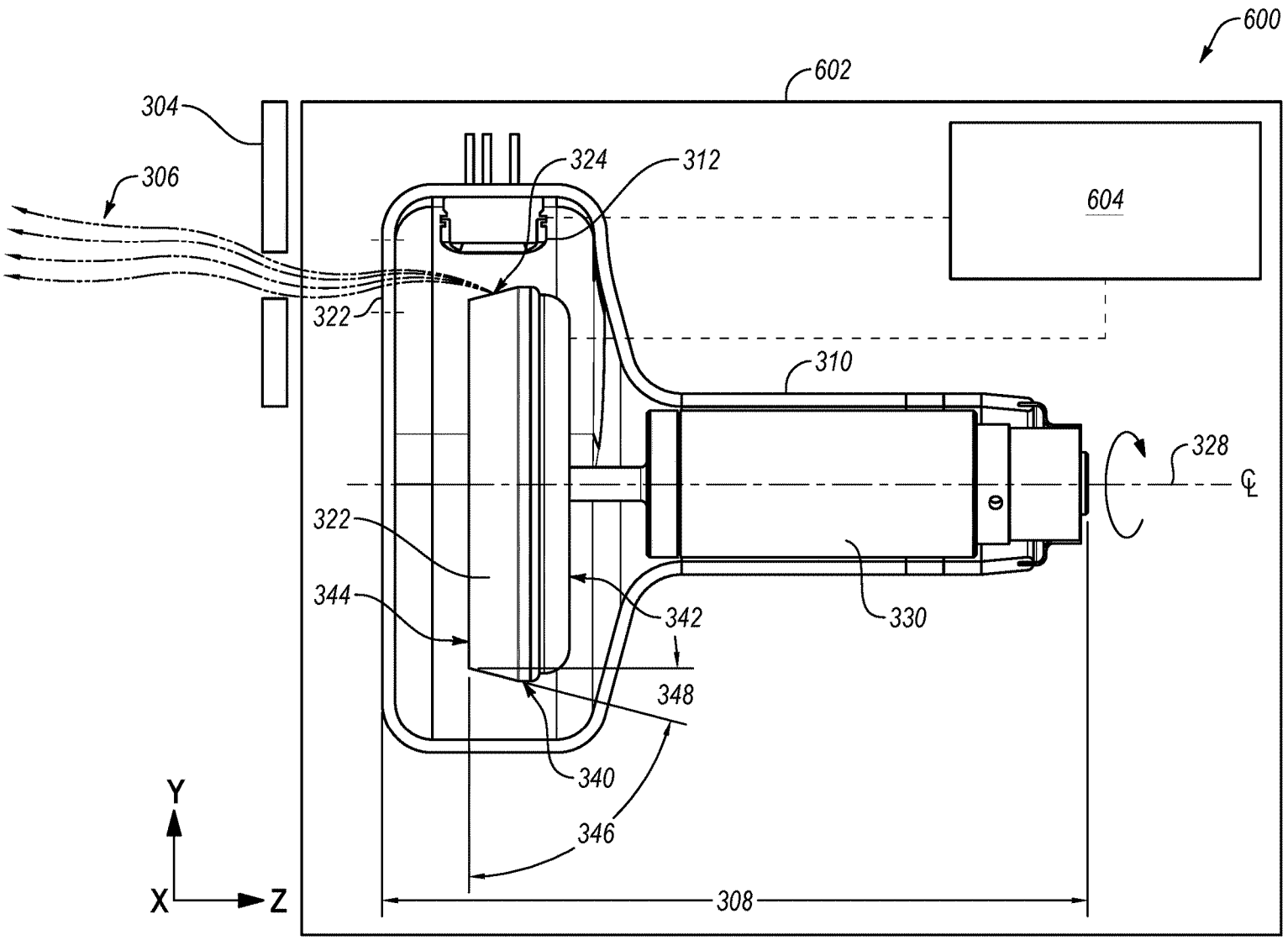
FIG. 6 illustrates a block diagram of another example x-ray tube.

FIG. 6 is a diagram of another example of an x-ray tube 600. The x-ray tube 600 may include similar features as the x-ray tube 300 described above with respect to FIG. 3, and such features are indicated with the numbering set forth above. In addition, the x-ray tube 600 includes a housing 602 at least partially surrounding the evacuated enclosure defined by the vacuum envelope 310. As illustrated, a high voltage power supply 604 may be integrated into the housing. The high voltage power supply 604 may supply power to the components of the x-ray tube 600, such as the cathode 312 and the anode 322, to generate x-rays. In some configurations, the high voltage power supply 604 includes a generator. Combining the high voltage power supply 604 and the housing 602 may decrease manufacturing costs of the x-ray tube 600 because the number of manufactured components is decreased. The housing 602 may include oil to cool the x-ray tube 600 and/or to electrically insulate the power supply 604 and the tube x-ray tube 600. Additionally or alternatively, combining the high voltage power supply 604 and the housing 602 may lead to a more compact x-ray tube 600 or x-ray imaging system. Furthermore, when combined with the configurations of the x-ray tubes described herein, a lighter, more compact x-ray tube may be implemented.

In one example embodiment, an anode (322) for an x-ray tube (300) may include a disk-shaped cylindrical body. The disk-shaped cylindrical body may include a bearing-facing surface (342), a window-facing surface (344) positioned opposite the bearing-facing surface (342), and a focal track (324) positioned between the window-facing surface (344) and the bearing-facing surface (342). The focal track (324) may be angled with respect to the window-facing surface (344), and the angle between the focal track (324) and the window-facing surface (344) may be between 45° and 89°. Additionally or alternatively, the focal track (324) may include a taper angle defined by an angle in a radial direction between the window-facing circular plane surface and a surface of the taper. The taper angle may be an angle between 45° and 89°. A surface or a curved surface may be positioned between the bearing-facing circular plane surface and the window-facing circular plane surface. The anode (322) may be a rotating anode.

The focal track (324) may include a material having a high atomic number. The disk-shaped cylindrical body may include a substrate. The substrate be include carbon fiber composite (CFC), titanium-zirconium-molybdenum (TZM), molybdenum-hafnium-carbon (MEW), other molybdenum alloy, or combination thereof. The focal track (324) may be formed by a coating on the taper of the disk-shaped cylindrical substrate. The focal track (324) may include a coating on the substrate. The coating may include tungsten (W), rhenium (Re), or combinations thereof. The focal track (324) may be formed by a coating on the taper of the disk-shaped cylindrical substrate.

In one configuration, the angle between the focal track (324) and the window-facing surface (344) may be between 65° and 85°. In another configuration, the angle between the focal track (324) and the window-facing surface (344) may be between 74° and 83°.

The anode (422) may include at least two radial slots (450) in the focal track (424). At least one of the slots (450) may be angled such that one edge of the focal track (424) overlaps another edge of the focal track (424).

In another example embodiment, an x-ray tube (300) may include an evacuated enclosure, an anode (322) disposed within the evacuated enclosure, a bearing assembly (330) configured to permit the anode (322) to rotate around an anode rotation axis (328), and a cathode (312) disposed within the evacuated enclosure. The cathode (312) may be configured to emit electrons towards the anode (322) to generate x-rays from electrons impinging on the anode (322). The cathode (312) may be oriented transverse to the anode rotation axis (328). Additionally or alternatively, the cathode (312) may be oriented substantially radially inward or outward from the anode (322).

The cathode (312) may be configured to emit electrons substantially radially inward towards the anode rotation axis (328). The anode (322) may be configured to generate x-rays in a direction substantially parallel to the anode rotation axis (328). A window (314) may be positioned transverse to the anode rotation axis (328). The window (314) may include an x-ray transmissive material to allow x-rays to be emitted from the x-ray tube (300) through the window (314). A plane formed by the window (314) may be substantially parallel to a window-facing surface (344) of the anode (322).

The bearing assembly (330) of the x-ray tube (300) may include a rotor assembly configured to rotate the anode (322) using electromagnetic fields. The bearing assembly (330) may include a ball bearing assembly with at least one race, a roller element bearing, a plain bearing, a sleeve bearing, a journal bearing, or liquid metal bearing. A shaft may couple the anode (322) to the bearing assembly (330).

A focal track (324) may be positioned between a window-facing surface (344) of the anode (322) and a bearing-facing surface (342) of the anode (322). The focal track (324) may be angled with respect to the window-facing surface (344), and the angle between the focal track (324) and the window-facing surface (344) may be between 45° and 89°, between 65° and 85, and/or between 74° and 83°.

A housing (602) may at least partially surround the evacuated enclosure, and a high voltage power supply (604) may be integrated into the housing (602). The housing (602) may include x-ray shielding material and a window (314) to allow x-rays to be emitted from the x-ray tube (300) through the window (314). A plane formed by the window (314) may be substantially parallel to a window-facing surface (344) or a bearing-facing surface (342) of the anode (322).

The anode (322) may be a disk-shaped anode. The anode (322) may include a bearing-facing circular plane surface proximal to the bearing assembly (330). The anode (322) may include a surface or a curved surface adjacent to the bearing-facing circular plane surface (342) forming the circumference of the disk-shaped anode (322).

The anode (322) may include a focal track (324) angled between 1° and 45°, 5° and 25°, or 7° and 16° with respect to the anode rotation axis (328). The focal track (324) may be formed by a target coating on the anode (322).

In another example embodiment, a method of forming an anode (322) for an x-ray tube (300) may include providing a disk-shaped cylindrical anode (322). The anode (322) may include a bearing-facing surface (342), a window-facing surface (344) positioned opposite the bearing-facing surface (342), and taper formed between the window-facing circular plane surface and the bearing-facing surface (342). The taper may be angled with respect to the window-facing surface (344), and the angle between the taper and the window-facing surface (344) is between 45° and 89°. The method may include forming a focal track (324) on the taper. The focal track (324) may be configured to generate x-rays when electrons strike the focal track (324).

The focal track (324) may be formed by depositing a coating material. Depositing the coating material may include ion beam enhanced deposition (MED), physical vapor deposition (PVD), chemical vapor deposition (CVD), plasma-enhanced chemical vapor deposition (PECVD), or an atomic layer deposition (ALD). The material of the coating may include tungsten (W), rhenium (Re), or combinations thereof. A material of the disk-shaped cylindrical anode (322) may include carbon fiber composite (CFC), titanium-zirconium-molybdenum (TZM), molybdenum-hafnium-carbon (MHC), other molybdenum alloy, or combination thereof.

The taper, the bearing-facing surface (342), or the window-facing surface (344) may be formed by grinding, polishing, lapping, abrasive blasting, honing, electrical discharge machining (EDM), milling, lithography, industrial etching/chemical milling, or laser texturing the disk-shaped cylindrical substrate.

In another embodiment, an anode (322) for an x-ray tube (300) may include a disc-shaped anode substrate. The substrate may include a bearing-facing circular plane surface proximal to the bearing assembly (330), a curved surface adjacent to the bearing-facing circular plane surface forming the circumference of the disc-shaped anode (322), and a taper formed adjacent to the curved surface with a radially inward angle at an angle between 45° and 89° with the bearing-facing circular plane surface. The anode (322) may include a focal track (324) formed by a coating on the taper of the disk-shaped cylindrical substrate.

All references recited herein are incorporated herein by specific reference in their entirety.

Reference throughout this specification to an "example" or an "embodiment" means that a particular feature, structure, or characteristic described in connection with the example is included in at least one embodiment of the invention. Thus, appearances of the words an "example" or an "embodiment" in various places throughout this specification are not necessarily all referring to the same embodiment.

By the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

Furthermore, the described features, structures, or characteristics may be combined in a suitable manner in one or more embodiments. In the following description, numerous specific details are provided (e.g., examples of layouts and designs) to provide a thorough understanding of embodiments of the invention. One skilled in the relevant art will recognize, however, that the invention can be practiced without one or more of the specific details, or with other methods, components, layouts, etc. In other instances, well-known structures, components, or operations are not shown or described in detail to avoid obscuring aspects of the invention.

While the forgoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited. Various features and advantages of the invention are set forth in the following claims.

What is claimed is:

1. An anode for an x-ray tube, comprising:
a disk-shaped cylindrical body including:
a bearing-facing surface,
a window-facing surface positioned opposite the bearing-facing surface, and
a focal track positioned between the window-facing surface and the bearing-facing surface, wherein the focal track is angled with respect to the window-facing surface, and the angle between the focal track and a plane of the window-facing surface is between 45° and 89°.

2. The anode assembly of claim 1, wherein the window-facing surface is parallel to a diameter of the disk-shaped cylindrical body.

3. The anode assembly of claim 1, wherein:
the disk-shaped cylindrical body comprises a substrate including carbon fiber composite (CFC), titanium-zirconium-molybdenum (TZM), molybdenum-hafnium-carbon (MEW), other molybdenum alloy, or combination thereof; and
the focal track comprises a coating on the substrate, the coating comprising tungsten (W), rhenium (Re), or combinations thereof.

4. The anode assembly of claim 1, wherein the angle between the focal track and the window-facing surface is between 65° and 85°.

5. The anode assembly of claim 1, wherein the angle between the focal track and the window-facing surface is between 74° and 83°.

6. The anode assembly of claim 1, wherein the anode includes at least two radial slots in the focal track.

7. The anode assembly of claim 6, wherein at least one of the slots is angled such that one edge of the focal track overlaps another edge of the focal track.

8. The anode assembly of claim 1, wherein the anode is a rotating anode.

9. An x-ray tube, comprising:
an evacuated enclosure;
an anode disposed within the evacuated enclosure;
a bearing assembly configured to permit the anode to rotate around an anode rotation axis; and
a cathode disposed within the evacuated enclosure, the cathode configured to emit electrons towards the anode to generate x-rays from electrons impinging on the anode, wherein the cathode is oriented transverse to the anode rotation axis.

10. The x-ray tube of claim 9, wherein:
the cathode is configured to emit electrons substantially radially inward towards the anode rotation axis; and
the anode is configured to generate x-rays in a direction substantially parallel to the anode rotation axis.

11. The x-ray tube of claim 9, further comprising a window positioned transverse to the anode rotation axis, the window comprising an x-ray transmissive material to allow x-rays to be emitted from the x-ray tube through the window.

12. The x-ray tube of claim 11, wherein a plane formed by the window is substantially parallel to a window-facing surface of the anode.

13. The x-ray tube of claim 9, further comprising a focal track positioned between a window-facing surface of the anode and a bearing-facing surface of the anode, wherein the focal track is angled with respect to the window-facing surface, and the angle between the focal track and the window-facing surface is between 45° and 89°.

14. The x-ray tube of claim 9, further comprising:
a housing at least partially surrounding the evacuated enclosure, and
a high voltage power supply integrated into the housing.

15. The x-ray tube of claim 9, wherein the anode includes a focal track angled between 1° and 45° with respect to the anode rotation axis.

16. The x-ray system of claim 15, wherein the focal track is formed by a target coating on the anode.

17. A method of forming an anode for an x-ray tube, the method comprising:
providing a disk-shaped cylindrical anode including:
a bearing-facing surface,
a window-facing surface positioned opposite the bearing-facing surface, and
a taper formed between the window-facing circular plane surface and the bearing-facing surface, wherein the taper is angled with respect to the window-facing surface, and the angle between the taper and a plane of the window-facing surface is between 45° and 89°; and
forming a focal track on the taper, wherein the focal track is configured to generate x-rays when electrons strike the focal track.

18. The method of claim 17, wherein the focal track is formed by depositing a coating material and includes:
an ion beam enhanced deposition (MED),
a physical vapor deposition (PVD),
a chemical vapor deposition (CVD),
plasma-enhanced chemical vapor deposition (PECVD), or
an atomic layer deposition (ALD).

19. The method of claim 18, wherein:
a material of the coating includes tungsten (W), rhenium (Re), or combinations thereof; and
a material of the disk-shaped cylindrical anode includes carbon fiber composite (CFC), titanium-zirconium-molybdenum (TZM), molybdenum-hafnium-carbon (MHC), other molybdenum alloy, or combination thereof.

20. The method of claim 17, wherein the taper, the bearing-facing surface, or the window-facing surface is formed by grinding, polishing, lapping, abrasive blasting, honing, electrical discharge machining (EDM), milling, lithography, industrial etching/chemical milling, or laser texturing the disk-shaped cylindrical substrate.

* * * * *